US007172015B2

(12) United States Patent
Miura et al.

(10) Patent No.: US 7,172,015 B2
(45) Date of Patent: Feb. 6, 2007

(54) HEAT EXCHANGER FOR AIR COMPRESSOR

(75) Inventors: Haruo Miura, Chiyoda (JP); Kazuki Takahashi, Tsuchiura (JP); Seiji Tsuru, Tsuchiura (JP); Minoru Taniyama, Ami (JP); Tomohiro Naruse, Chiyoda (JP); Toshio Hattori, Ushiku (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 114 days.

(21) Appl. No.: 10/920,359

(22) Filed: Aug. 18, 2004

(65) Prior Publication Data

US 2005/0082044 A1 Apr. 21, 2005

Related U.S. Application Data

(62) Division of application No. 09/921,926, filed on Aug. 6, 2001, now abandoned.

(30) Foreign Application Priority Data

Oct. 31, 2000 (JP) ..... 2000-337253

(51) Int. Cl.
*F28F 9/013* (2006.01)
*F28F 3/00* (2006.01)
*F02B 33/00* (2006.01)

(52) U.S. Cl. ..... 165/166; 165/162; 165/167

(58) Field of Classification Search ..... 165/67, 165/69, 76, 82, 157, 162, 165–167, 170; 415/177–180; 123/563, 559.1; 60/598, 60/599

See application file for complete search history.

(56) References Cited

U.S. PATENT DOCUMENTS

| | | | | |
|---|---|---|---|---|
| 3,775,972 | A * | 12/1973 | Perpall | 60/599 |
| 3,858,291 | A * | 1/1975 | Perpall | 29/890.03 |
| 3,957,106 | A * | 5/1976 | Whitfield | 165/9 |
| 4,367,789 | A * | 1/1983 | Moranne | 165/76 |
| 4,473,111 | A * | 9/1984 | Steeb | 165/153 |
| 4,596,285 | A * | 6/1986 | Dinulescu | 165/82 |
| 4,805,695 | A * | 2/1989 | Ishikawa et al. | 165/166 |
| 5,383,439 | A * | 1/1995 | Bock | 123/563 |

FOREIGN PATENT DOCUMENTS

| | | | |
|---|---|---|---|
| DE | 2161604 | A * | 6/1973 |
| JP | 8105386 | | 4/1996 |
| JP | 2000120585 | | 4/2000 |

* cited by examiner

*Primary Examiner*—Tho Duong
(74) *Attorney, Agent, or Firm*—Antonelli, Terry, Stout and Kraus, LLP.

(57) ABSTRACT

A heat exchanger used in a screw air compressor has a low temperature chamber through which low temperature fluid flows and a high temperature chamber through which high temperature fluid flows. The low temperature chamber and the high temperature chamber are separated by a partition plate. The high temperature chambers and the low temperature chambers are alternately arranged in layers, so that the low temperature chambers are disposed at both ends in a layered direction. Additionally, the flowing direction of the low temperature fluid in the low temperature chambers and the flowing direction of the high temperature fluid in the high temperature chambers are substantially orthogonal to each other.

4 Claims, 11 Drawing Sheets

HEAT EXCHANGER FOR AIR COMPRESSOR

CROSS REFERENCE TO RELATED APPLICATION

This application is a divisional application of U.S. Ser. No. 09/921,926, filed Aug. 6, 2001 now abandoned, the contents of which are incorporated hereby by reference.

BACKGROUND OF THE INVENTION

The present invention relates to a medium or small capacity air compressor which is used as a power air source or the like for factories, and more particularly to a heat exchanger provided in those air compressors.

A screw-type compressor and a compact turbo compressor are known as a medium or small capacity air compressor whose discharge pressure is approximately 0.7 MPa in gauge pressure and whose output power is in a class from less than 100 kW to several hundreds kW, and are used as a power air source for factories. An example of such an air compressor is disclosed in JP-A-8-105386 or JP-A-2000-120585. In these specifications, a laminated type of heat exchanger or a fin tube type of heat exchanger is used for cooling compressed air generated by the medium or small capacity turbo compressor.

In JP-A-8-105386, a gas cooler for cooling the compressed gas is inserted with a predetermined gap into a cooler shell through which the compressed gas flows while a seal part is formed on an outer circumferential part of the gas cooler for sealing the gap to divide the inside of the cooler shell into a high temperature side and a low temperature side, so that the seal part of the gas cooler has rigidity and sealability. The seal part projects from the outer circumferential part of the gas cooler, and is elastically contacted with an inner wall of the cooler shell. Further, JP-A-2000-120585 discloses a pressure container provided with a pair of rails having a recess part at one end thereof, in which a nest accommodated in the pressure container is provided with a roller to be fitted into the recess part after traveling on the rail, so that reliability and maintenance efficiency of the seal are improved.

The sealing ability is improved by way of each sealing method described in the above prior art, however, it becomes complicated to process the seal part because of its complicated structure. In addition, the assembling is troublesome because the elastic seal becomes resistant when the nest is inserted into a casing. Further, it is also difficult to completely prevent leakage.

BRIEF SUMMARY OF THE INVENTION

In view of disadvantages of the above prior art, an object of the present invention is to prevent the heat exchange efficiency from decreasing due to the leakage between a cooling apparatus nest and a casing, by a simple structure. Another object of the present invention is to provide a high performance heat exchanger capable of cooling high temperature fluid. The present invention achieves at least one of these objects.

In order to achieve the above-described object, according to one aspect of the present invention, there is provided a heat exchanger for an air compressor, comprising a heat exchanger nest having a plurality of low temperature chambers through which low temperature fluid flows and a plurality of high temperature chambers through which high temperature fluid flows, the low temperature chambers and the high temperature chambers being alternately arranged in layers through a partition plate interposed therebetween, wherein a flowing direction of the low temperature fluid in the low temperature chambers and a flowing direction of the high temperature fluid in the high temperature chambers are substantially orthogonal to each other, and the both ends of the layered heat exchanger nest are the low temperature chambers.

According to another aspect of the present invention, there is provided a heat exchanger for an air compressor, comprising a heat exchanger nest formed by alternately arranging a plurality of low temperature chambers through which low temperature fluid flows and a plurality of high temperature chambers through which high temperature fluid flows in layers through a partition plate interposed therebetween, wherein the number of the high temperature chambers is smaller than that of the low temperature chambers by one, and a flowing direction of the low temperature fluid in the low temperature chambers and a flowing direction of the high temperature fluid in the high temperature chambers are substantially orthogonal to each other.

In these respect, features, it is desirable that the low temperature fluid is cooling water and the high temperature fluid is compressed air. Further, the hear exchanger for an air compressor having these features may be provided in a screw compressor.

In the above-described aspects, it is desirable that the heat exchanger further comprises a container for accommodating the heat exchanger nest, in which the container is provided with a container side projecting seal formed on an inner surface of a side thereof, and the heat exchanger nest is also provided with a nest side projecting seal formed on a side thereof, wherein the container side seal and the nest side seal are coupled through a seal member which can be elastically deformed in contact with both seals, so as to form a seal part for partitioning the inside of the container into several portions.

Preferably, the nest side seal may be provided in the vicinity of an outlet of the low temperature fluid; the nest side seal may be provided so as to project from a bottom surface of the heat exchanger nest, so that compressive load is loaded on the seal member due to the mass of the heat exchanger nest; the cross sectional area of the seal member may be larger than those of contacting parts between the seal member and the container side seal, and the seal member and the nest side seal; the seal member may include at least one of ethylene-propylene rubber, acrylic rubber, silicone rubber, and fluoro-rubber, as a principal component; the seal member may be a gas tube seal which is constituted by forming a polymeric material into a tube, and sealing or injecting gas therein; and a clamp may be provided for pressing the heat exchanger nest to the container side seal.

DETAILED DESCRIPTION OF THE INVENTION

Figure 1:
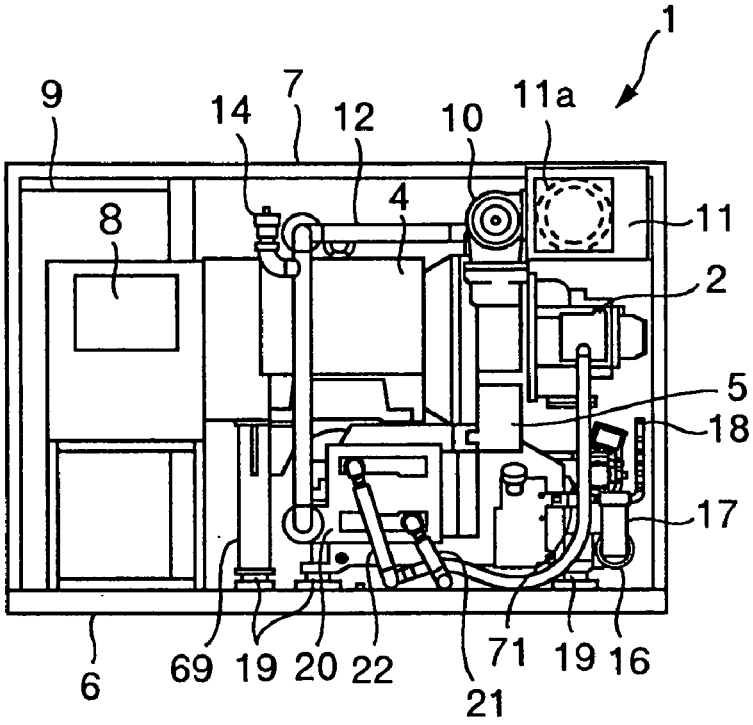
FIGS. 1–4 are a front view, a plane view, and a side view of an embodiment of a screw compressor having a heat exchanger according to the present invention, and a cross sectional view of a casing of the screw compressor, respectively.

Now, some embodiments of the present invention will be described referring to the drawings. At first, findings based on preliminary tests related to the present invention will be described. In a heat exchanger according to the present invention, there are formed flow passages which are separated by a partition plate and orthogonal to each other, through which two different kinds of working fluids flow respectively. When the working fluids flow through the orthogonal flow passages respectively, the heat is transferred from a high temperature chamber on a high temperature side to a low temperature chamber on a low temperature side through the partition plate. This allows the fluid on the high temperature side to be cooled. The high temperature chamber and the low temperature chamber make a pair, and a plurality of pairs are stacked in multiple layers to form a heat exchanger, referred to as a nest. Examples of such heat exchangers are described in Heat Transfer Engineering Data Book (forth Edition), published by the Japan Society of Mechanical Engineers, p. 261. According to this publication, this type of heat exchanger is classified as a compact heat exchanger. In the compact heat exchanger, since a heat transfer coefficient on the high temperature chamber side is small when using cooling water as a fluid for the low temperature chamber and using compressed air as a fluid for the high temperature chamber, a corrugated fin is employed or a slit referred to as a louver is provided in the corrugated fins to increase heat transfer area and to improve the heat transfer coefficient. In view of this advantage regarding the miniaturization, it is readily thought of to apply the compact heat exchanger to a compressor. However, since the difference between the heat transfer coefficients is large in the heat exchanger for the air compressor as described above, it is not possible to achieve sufficient performance by simply applying the compact heat exchanger to the air compressor. Thus, according to the present invention, there is used a nest in which the number of high temperature chambers is larger than that of low temperature chambers as described below in detail, in consideration of the property of a compact heat exchanger and the economy.

Figure 16:
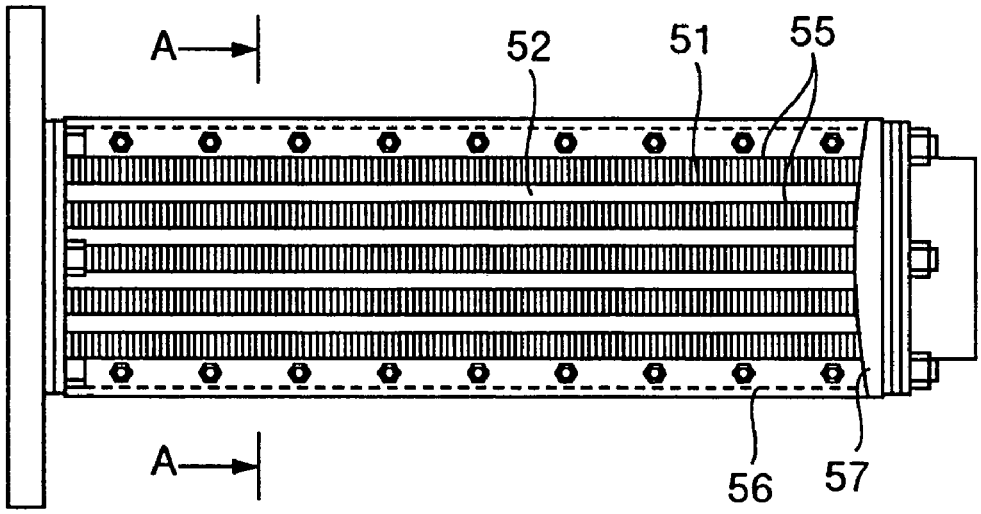
FIGS. 16–19 are a plane view, a side view, and an A—A cross sectional view of the heat exchanger used in a preliminary test, and a view for explaining a state where an outer gas chamber is closed using the A—A cross sectional view, respectively.
Figure 17:
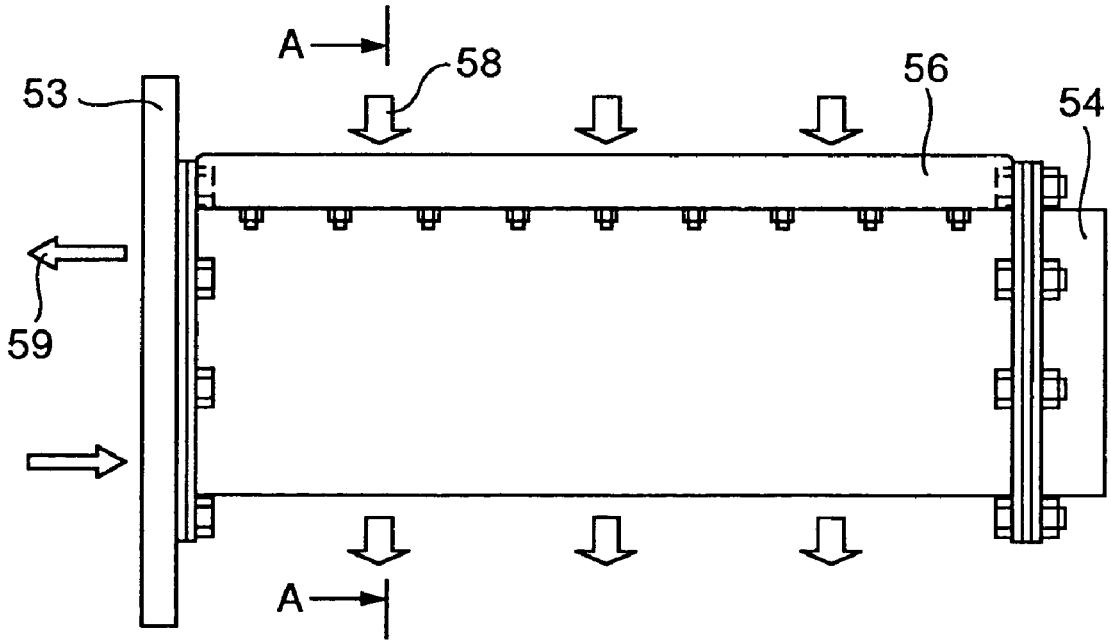

A nest having five lines of high temperature chambers and four lines of low temperature chambers was fabricated so as to make the number of the high temperature chambers larger than that of the low temperature chambers, and then its cooling ability was measured, however, desired cooling ability (heat passing coefficient) can not be obtained. Then, temperature distribution of the fluid in the high temperature chambers (hereinafter, referred to as gas chambers) disposed at both ends, and gas outlet temperature of the gas chambers disposed between the low temperature chambers (hereinafter, referred to as water chambers) at the middle of the nest were measured. The result will be described referring to FIGS. 16 to 20. FIGS. 16 and 17 are a plane view and a side view of a corrugated fin type heat exchanger nest designed as a cooler for an air compressor, respectively.

The total number of the gas chambers 51 is five, and that of the water chambers 52 is four, so that the gas chambers 51 is disposed at both ends. The heat passing amounts on a water side and a air side are balanced by increasing the heat transfer area on the air side of which the thermal conductivity is lower than that of water. A gas flow direction 58 in FIG. 17 is from top to bottom, while the cooling water 59 enters from a lower part of a front side tube plate 53, and changes its direction at a rear side water chamber case 54 to exit from an upper part of the front side tube plate 53. Accordingly, the two kinds of working fluids are separated by the partition plate 55 and orthogonal to each other. Heat is transferred from the high temperature side to the low temperature side through the partition plate 55. The high temperature fluid flows from top to bottom, while the cooling water enters from the lower part of the front side tube plate 53 so as to be orthogonal to the flow of the high temperature fluid, then changes its direction at the rear side water chamber case 54, and flows out from the upper part of the front side tube plate. Corrugated fins are provided in the gas chamber so as to increase the heat transfer area by the fins. The heat transfer area is increased by the fins, so that the lower thermal conductivity as compared with water is compensated.

Figure 18:
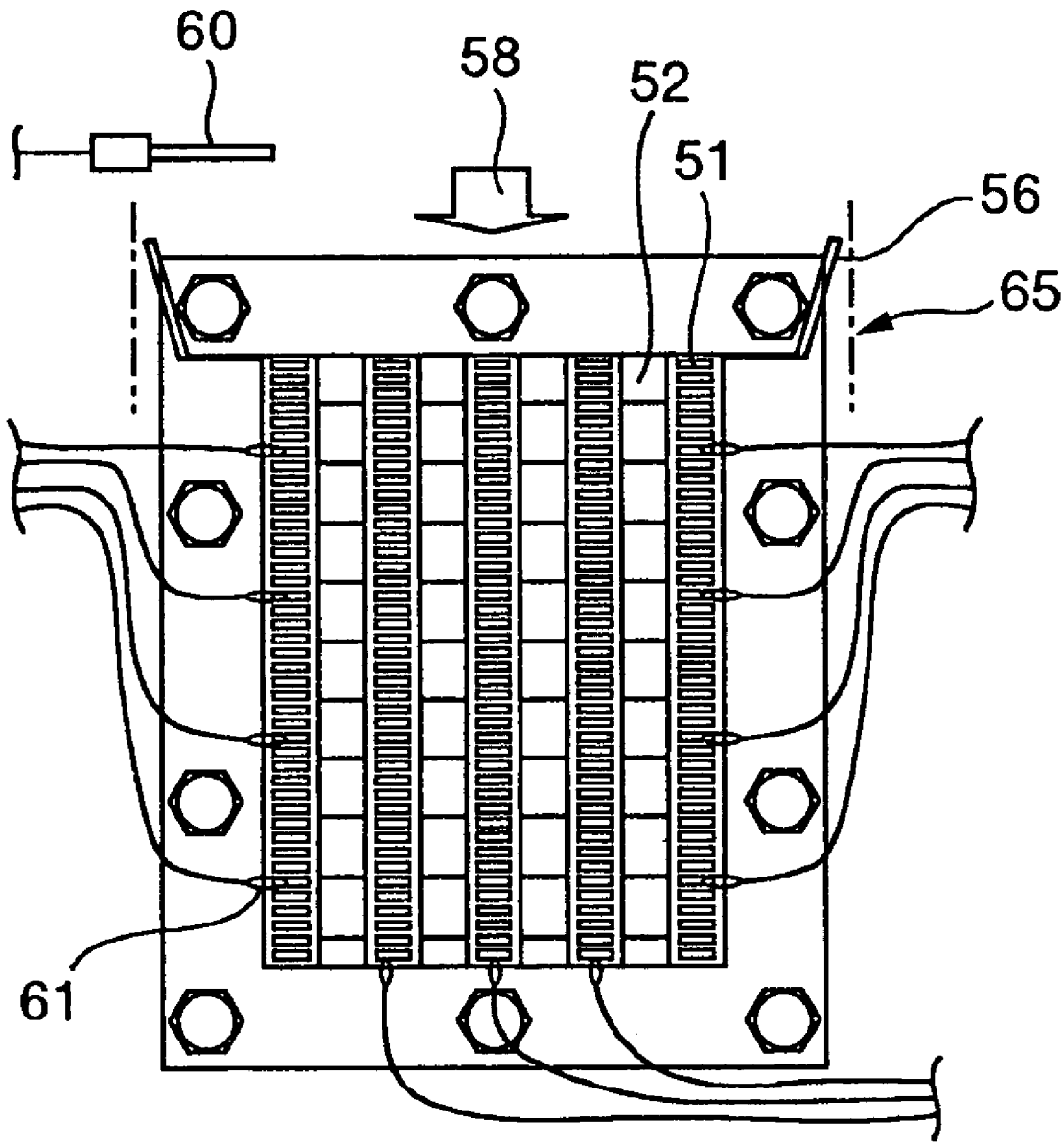
Figure 19:
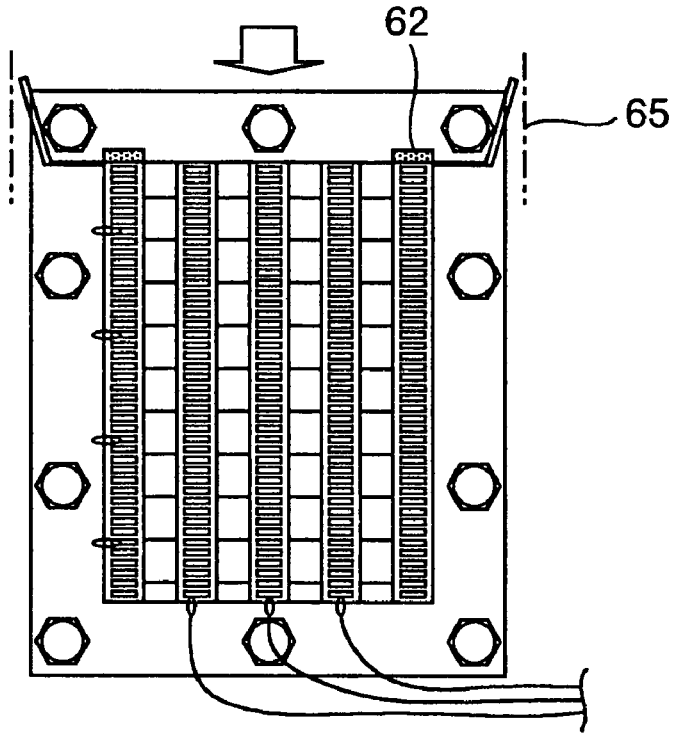

Although not shown, a heat exchanger for an air compressor is formed by enclosing and attaching the nest used in this embodiment to a casing. In this case, a gap formed between the nest and the casing is sealed with seal plates 56, 57 at a part around a nest inlet. By using this heat exchanger, a cooling ability test for high temperature compressed air was performed. FIG. 18 is a sectional view taken along a line A—A in FIGS. 16 and 17, and is a sectional view at a position of ¼ of the nest length. FIG. 18 also shows measuring positions of gas temperature. The high temperature air flowing from the top flows toward the bottom while the air is cooled in the gas chamber 51. The gap between the nest and a casing wall 65 is sealed with the seal plate 56. It was found that a small amount of air leaks from the gap and flows to the nest outlet side while the air maintains high temperature. Temperature sensors 61 were provided at the outlets of the gas chambers disposed at both ends and the gas chambers disposed in the middle in order to measure the gas temperatures. The temperature sensor 60 was provided to measure the temperature at the inlets. FIG. 19 shows a cross section when the inlets of the gas chambers disposed at both ends of the nest shown in FIGS. 16, 17 are closed by closed plates 62. FIG. 19 is a cross sectional view taken along the line A—A in FIGS. 16 and 17. Temperature sensors were placed on three lines in the middle to measure the outlet temperatures of the gas chambers.

Figure 20:
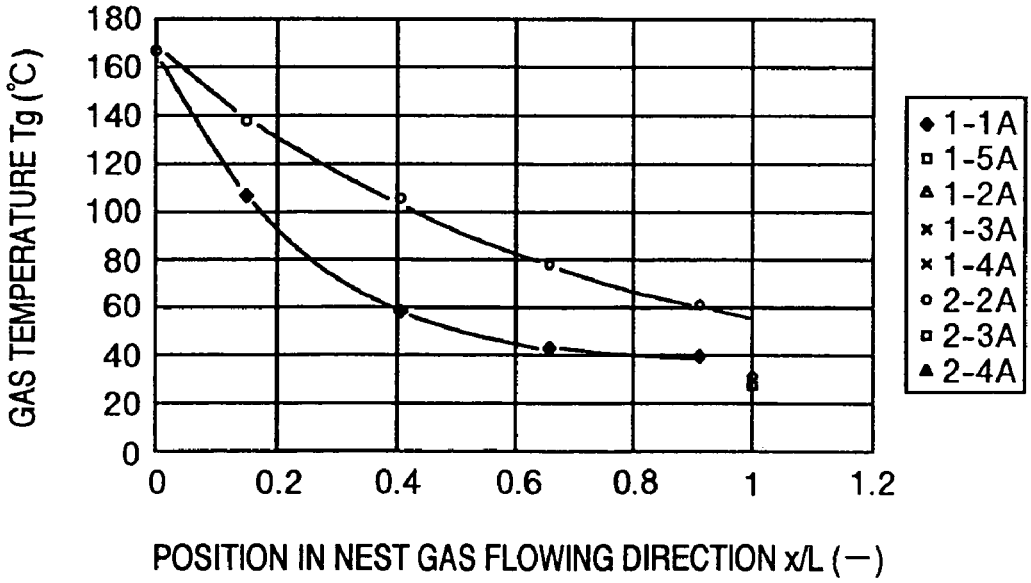
FIG. 20 is a view for explaining cooling performance in the preliminary test.

FIG. 20 shows results of the temperature measurement in these two cases. With respect to symbols shown in FIG. 20, the first number thereof denotes the test order, and the next number denotes a position of the gas chamber at which the measurement is performed, while the last character designates a cross sectional position. For example, in the case of "1–3A", the first number "1" is the test number corresponding to the case where five gas lines and four water chambers are provided, the "3" denotes the third line of the gas chambers, and the "A" denotes a A—A cross sectional position. When the first number is "2", this indicates a test result of the case where the gas chambers disposed at both ends are closed. As apparent from this drawing, the outlet temperatures of the gas chambers disposed at both ends are significantly high as compared With the outlet temperatures of the gas chambers disposed in the middle. Also, even if the gas chambers disposed at both ends are closed, the outlet temperatures of the gas chambers disposed in the middle are little changed. In both tests, of course, the quantities of heat at the inlets are the same. Accordingly, there was obtained a test result that the cooling ability is higher in the case that the gas chambers disposed at both ends are absent, even if the heat transfer area reduces to be ⅗. This means that, in the outside gas chambers, the gap between the casing and the nest becomes wide. The casing is heated by the high temperature fluid because the heat exchanger according to this embodiment encloses the nest in the casing. Further, since there is the leakage of the high temperature fluid, the heat is input from the outside into the fluid in the gas chambers disposed at both ends of the nest, thereby the cooling performance is reduced, as estimated.

Figure 2:
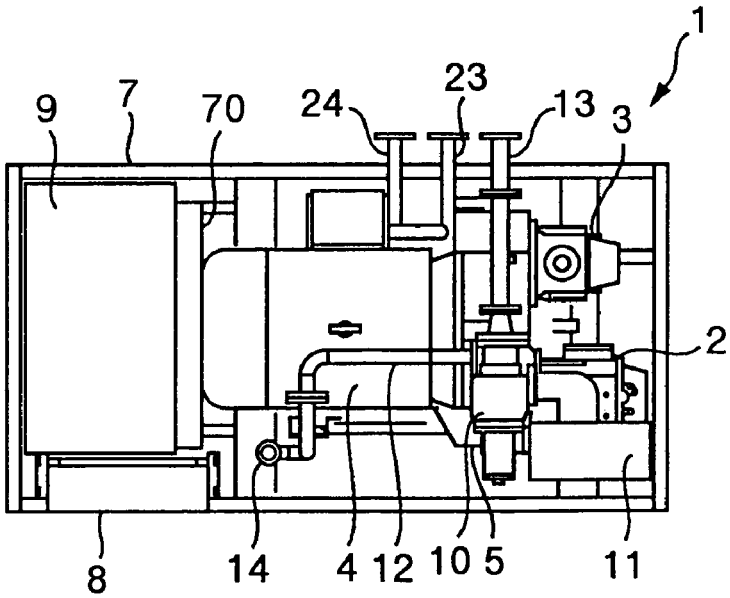
Figure 3:
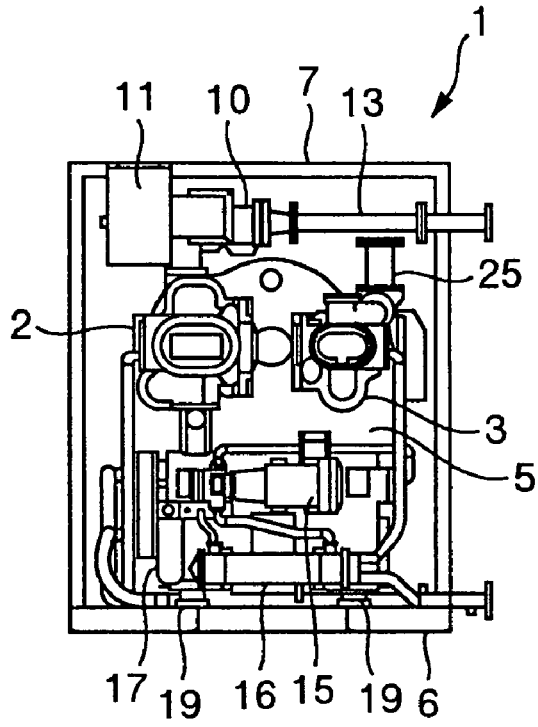
Figure 4:
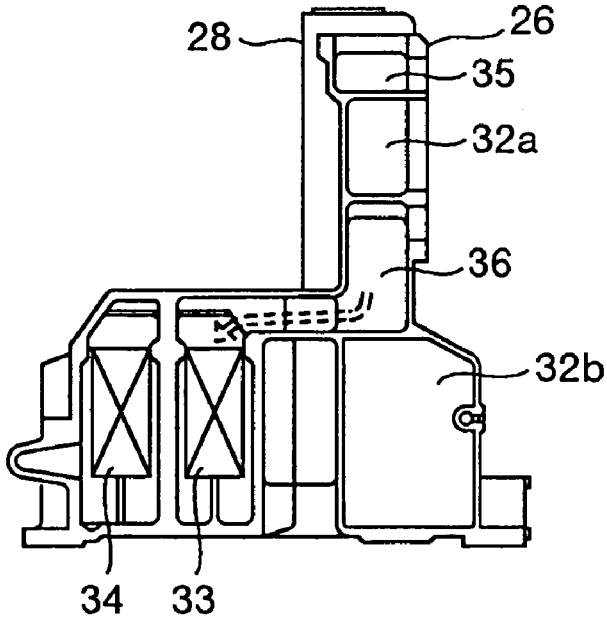
Figure 5:
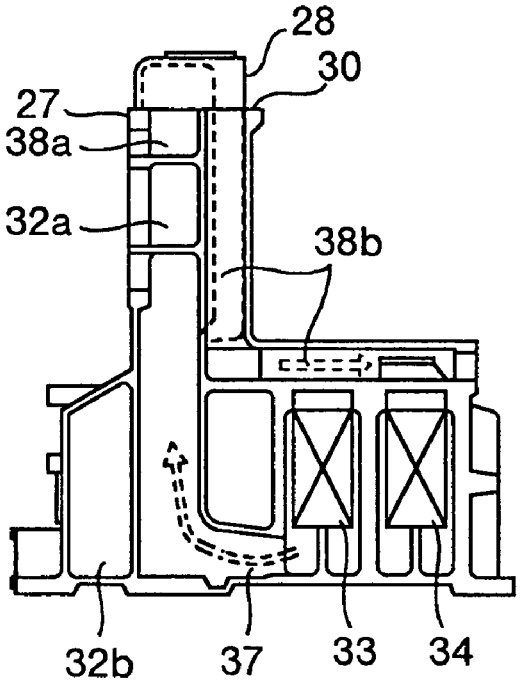
FIG. 5 is another cross sectional view of the casing shown in FIG. 4.

Some embodiments of the present invention based on the above-described findings will be described referring to FIGS. 1 to 15. FIGS. 1 to 3 are a plane view, a top view, and a side view of a two-stage screw compressor provided with a heat exchanger according to the present invention respectively, and in these drawings, a cover constituting a package is eliminated. FIGS. 4 and 5 are cross sectional views showing the structure of a casing part in which a heat exchanger is enclosed.

The screw compressor according to this embodiment is a two-stage compressor including a low pressure stage (a first stage) compressor and a high pressure stage (a second stage) compressor. Fluid to be treated is air, and a discharge pressure is in order of approximately 0.7 to 1.0 MPa in gauge pressure. This compressor is used as a general industrial factory air source, for example. The configuration of the compressor will be described below in detail. The low pressure stage compressor 2 and the high pressure stage compressor 3 are mounted on a speed-up gears casing 5, and a rotor which is provided in each stage compressor is rotated by a motor 4. Each air passage for first stage suction, first stage discharge, second stage suction, and second stage discharge is formed by dividing the inside of the speed-up gears casing 5 with partition walls. The high temperature air pressurized in each stage compressor passes through respective passages, and cooled in an intercooler and an aftercooler described below. Cooling water is supplied to these coolers through a cooling water piping 21. The cooling water is, at first, guided to a water chamber cover 20, then guided to the nest, thereafter discharged from an outlet piping 22. The screw compressor has an oil pump 15, an oil cooler 16, a suction filter 11, a volume control valve 10, and other accessories.

FIG. 4 shows an inlet part of the intercooler and a state of the cooler enclosed and attached. In FIG. 4, a compressing stage is eliminated. The high temperature air pressurized in the first stage compressor enters into an intercooler chamber 33 through a passage 36 in the casing. FIG. 5 shows an outlet part of the intercooler and an inlet part into the aftercooler. In FIG. 5, the compressing stage is also eliminated. The air cooled in the intercooler is taken into the two-stage compressor through the passage 37. The high temperature air pressurized in the two-stage compressor flows into an aftercooler chamber 34 through a passage 38 in the casing. In this embodiment, a gap formed between the casing and the cooler nest is sealed around an upper inlet.

Figure 6:
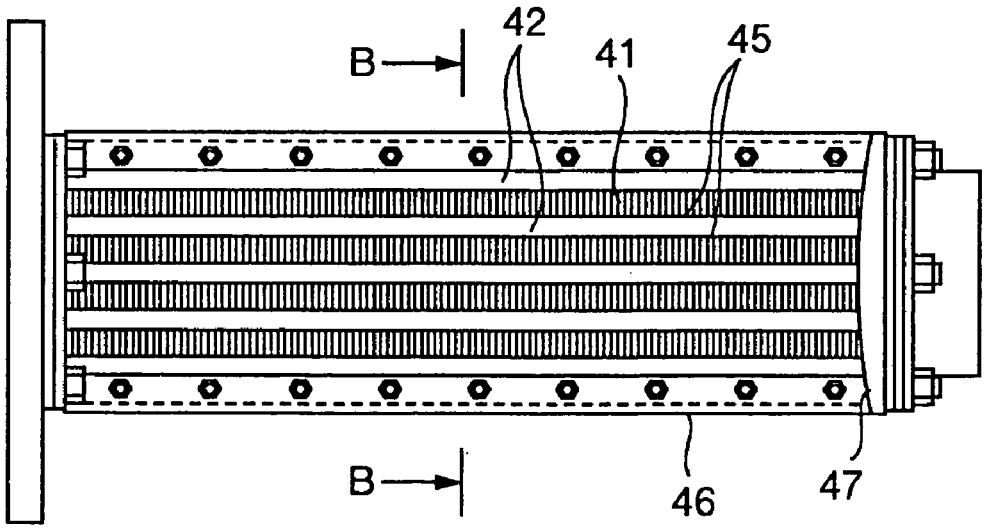
FIG. 6 is a plane view of one embodiment of a heat exchanger according to the present invention.
Figure 7:
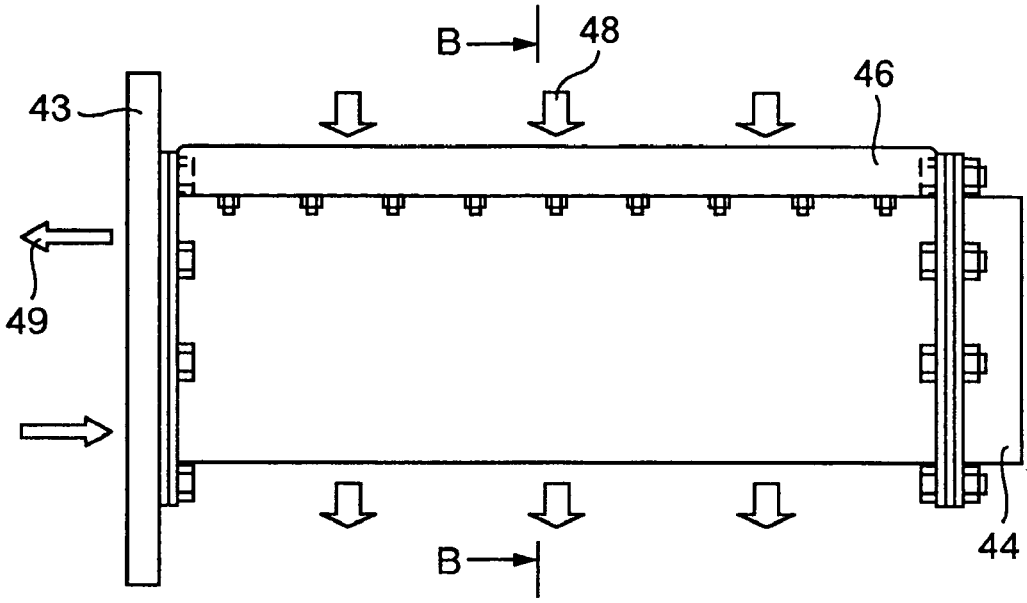
FIG. 7 is a side view thereof.

FIGS. 6 and 7 show the nest structure. FIG. 6 is a plane view of the nest seen from a direction in which the gas flows into the nest. FIG. 7 is a side view of FIG. 6. In this embodiment, the high temperature fluid flows from top to bottom, while the cooling water enters from a lower part so as to be orthogonal to the flow of the high temperature fluid, and flows out from an upper part. The nest according to this embodiment has four lines of gas chambers 41 and five lines of water chambers 42. The chambers are arranged so that the water chambers 42 are at both ends thereof. On the other hand, each gas chamber 41 is provided with the water chambers at both sides. In FIG. 7, the gas 48 flows from top to bottom, while the cooling water 49 enters from a lower part of the front side tube plate 43, then changes its direction at a rear side water chamber case 44, thereafter flows out from an upper part of the front side tube plate. The two kinds of working fluids flow while being separated by the partition plate 45 and orthogonal to each other. Heat is transferred from a high temperature chamber side to a low temperature chamber side through the partition plate. Corrugated fins are formed in the gas chamber. The gap between the nest and the casing is sealed with seal plates 46 and 47 around the nest inlet. Additionally, a part around the nest outlet may be sealed also.

Figure 8:
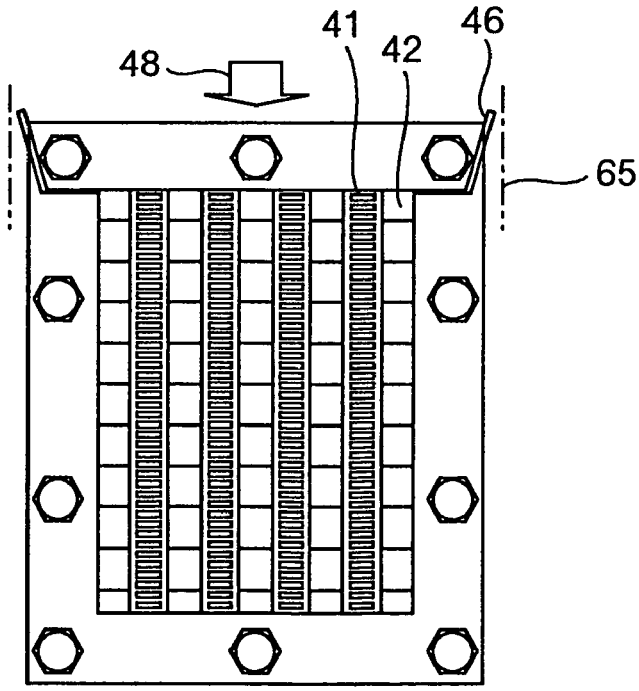
FIG. 8 is a cross sectional view along lines B—B of FIGS. 6 and 7.

FIG. 8 shows a B—B sectional view of the cooler nest shown in FIGS. 6 and 7. The water chambers 42 are placed at both ends thereof and each gas chamber 41 is sandwiched between the water chambers. By using the cooler nest according to the embodiment, the high temperature fluid is sufficiently cooled because it passes through the gas chambers sandwiched between the water chambers. Additionally, although it is difficult to achieve complete sealing by sealing the gap between the casing and the nest with the seal plate 46, a small amount of leaked high temperature fluid does not heat the fluid flowing in the gas chambers, and alternately the high temperature fluid is cooled by the cooling water flowing around the high temperature fluid, so that the leaked gas is also efficiently cooled.

Another embodiment of the present invention will be described referring to FIGS. 9 to 15. This embodiment describes the case where an intercooler and an aftercooler are individually constituted, but of course, a plurality of heat exchangers may be integrated as is the case with the above-described embodiment. A corrugated-fin-type heat exchanger nest 31 is enclosed in a container 30 constituting the aftercooler or the intercooler. On the bottom parts of both, right and left sides of the heat exchanger nest 31, there are provided fixing members 88 having a U-shape in its cross section. On both of right and left inner wall surfaces of the container 30, which correspond to the fixing members 88, projections 72 are formed.

By putting a seal member 71 on an upper surface of the projection 72 and holding the seal member 71 in a groove 87 formed by the fixing member 88, a space inside of the container 30 is divided to a space through which the high temperature air 48 flows, and a space through which the low temperature air 50 cooled by the heat exchange in the heat exchanger nest 31 flows. In this case, the heat exchanger nest 31 and the seal member 71 are hermetically held by closely contacting an inner wall surface 75 of the fixing member 88 with an outer surface 74 of the seal member 71. The seal member 71 is a sufficient elastically deformable material such as rubber. Additionally, with respect to the shape of the seal member 71, a cutout part is formed on the fixing member 88 side, and the projection side 72 is made to be a taper shape, in consideration of the adherability with the projection 72 and the fixing member 88.

In this embodiment constructed so, heat degradation of the seal member 71 formed from rubber or the like can be reduced because the seal member 71 is placed on the low temperature air 50 side. Since the seal member 71 is placed under the heat exchanger nest 31, the seal member 71 is compressively deformed by the weight of the heat exchanger nest 31, so that the surface pressure can be securely applied to the seal surface.

The seal member 71 is an elastically deformable materiel such as rubber, so that the securely sealing can be performed without generating any gap even if a surface of the projection72 of the container 30 is very uneven like a casting surface. Additionally, the inner wall surface 75 of the fixing member 88 and an outer surface 26 of the seal member 71 are closely contacted, so that the occurrence of gaps, which may occur when the heat exchanger nest 31 is fixed, can be prevented.

Then, thickness h (see FIG. 9) of the seal member 71 is set such that a surface 73 of the seal member 71 abutted to the projection 72 is lower than a bottom surface 8 of the fixing member 88 and a tube plate 89, which bottom surface 8 is a lowest surface of the heat exchanger nest 31. This allows the seal member 71 to be compressively deformed by the weight of the heat exchanger nest 31 when the heat exchanger nest 31 is placed in the container 30. Further, since the surface 73 of the seal member 71 abutted to the projection 72 and the outer surface 74 of the seal member 71 abutted to the fixing member 88 have smaller cross sectional areas than the cross sectional area of the seal member 71, so that the rigidity in the contact surface of the seal member 71 can be small. Accordingly, it is possible to contact the outer surface 74 of the seal member 71 to the inner wall surface 75 of the fixing member 88, easily.

By the way, the inlet air temperature of the heat exchanger such as an intercooler or an aftercooler used in the screw compressor reaches to not less than approximately 200 degrees Celsius, at pressure of approximately 0.1 MPa. The desirable seal materials for using under such a high temperature are ethylene-propylene rubber, acrylic rubber, silicone rubber, fluororubber, and the other material having high heat resistance.

Figure 9:
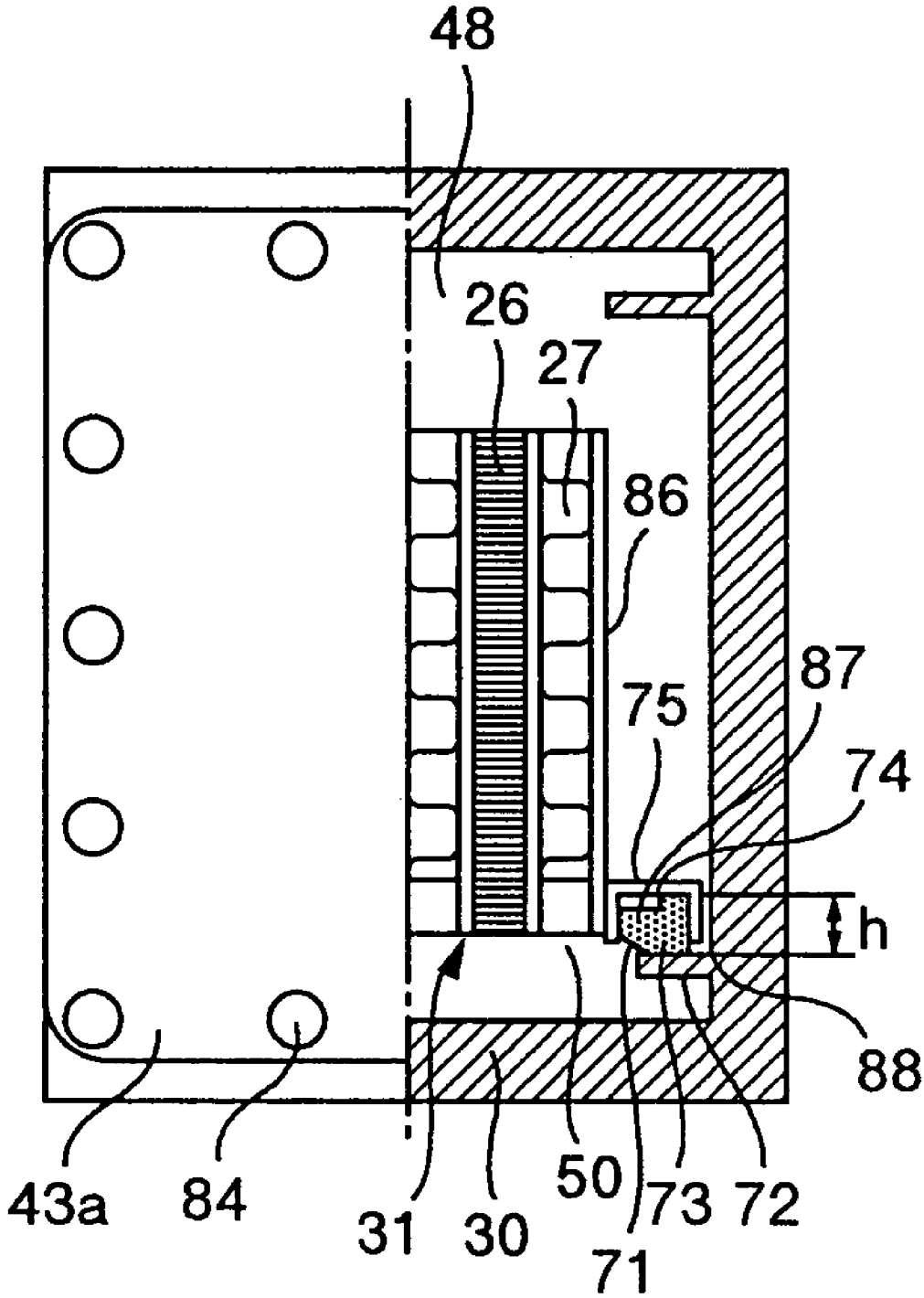
FIG. 9 is a cross sectional views of another embodiment of the heat exchanger according to the present invention.
Figure 10:
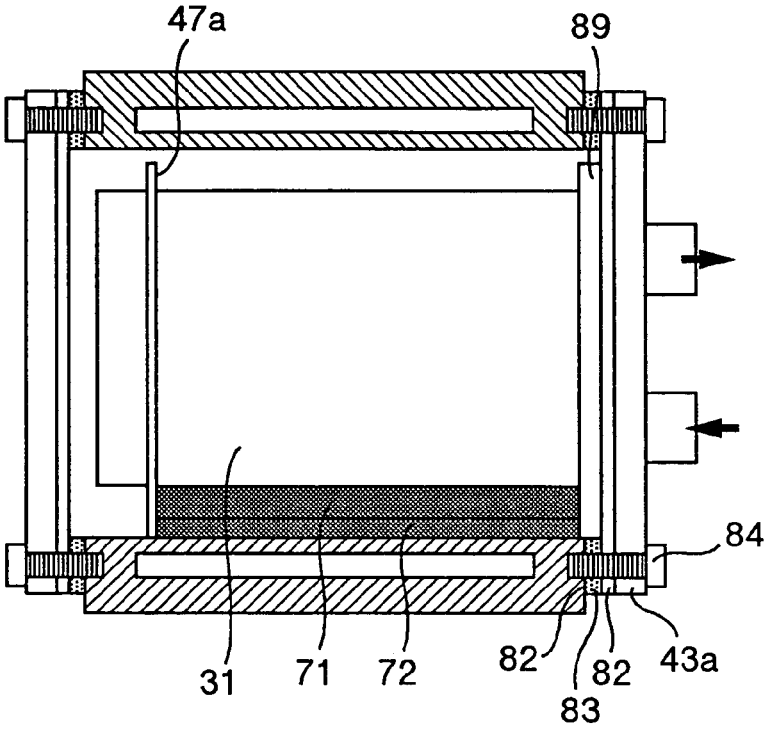
FIG. 10 is a front view of the heat exchanger shown in FIG. 9.
Figure 11:
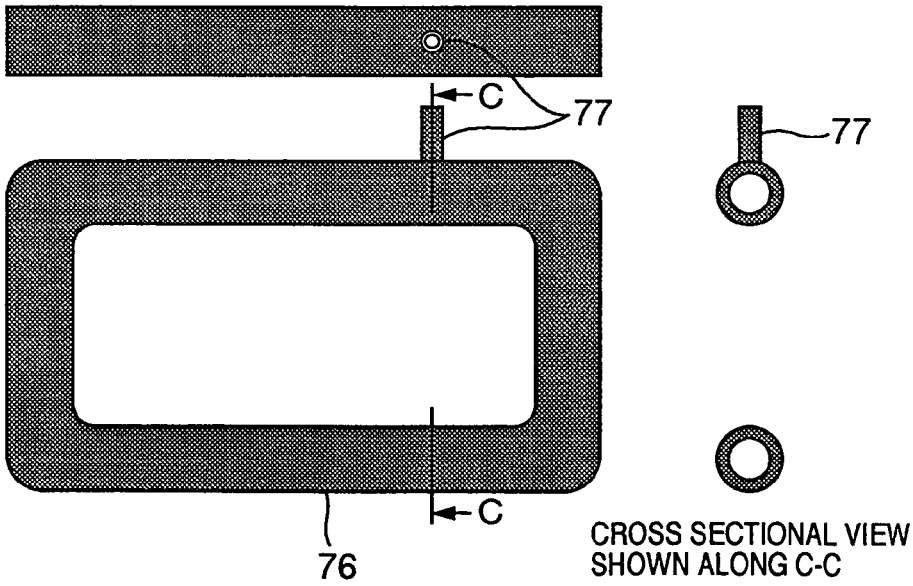
FIG. 11 is a three-side view of another embodiment of a seal member according to the present invention.

A variation of the embodiment shown in FIG. 9 is shown in FIG. 11. FIG. 11 is a three-side view showing a front view, a top view, and a side sectional view together. A gas tube seal 76 is formed by forming a polymeric material having high heat resistance and high elasticity into a tube shape and by sealing or injecting gas such as air therein. By using a tube-shaped seal, the elastically deforming amount can be increased. Particularly, a gas filling port 77 and the piping for filling the gas from outside of the container 30 to the gas filling port 77 are provided, so that reliable sealing can be obtained by only filling the gas in the gas tube seal 76 and by pressuring the gas, after the heat exchanger nest 31 is fixed to the container 30. When the heat exchanger nest 31 is removed from the container 30, the heat exchanger nest 31 can be readily removed from the container 30 only by degassing the tube 76. The preferable materials for the tube is polyacetal, fluororesin, or the other material having high heat resistance and elasticity.

Figure 12A:
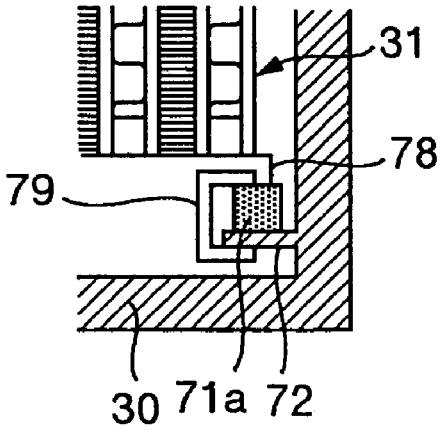
FIGS. 12A, 12B, and 13 are cross sectional views of variations of a seal member according to the present invention.
Figure 12B:
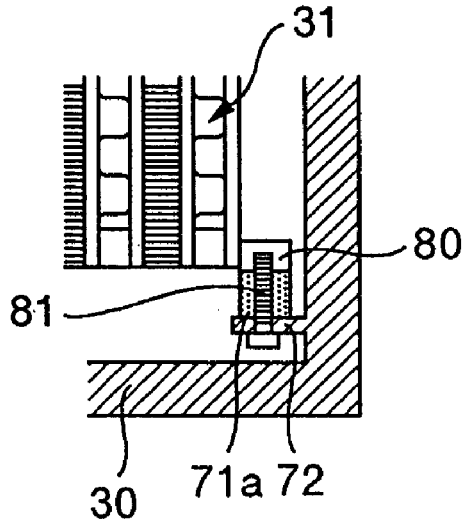

Another variation of the present invention is shown in FIGS. 12A and 12B. In FIG. 12A, the weight of the heat exchanger nest 31 is loaded on the seal member 71*a* placed on the projection 72 through a clasp 78 provided on the bottom part of the heat exchanger nest 31. Then, the clasp 78 and the projection 72 are clamped by using a latch 79. Another clamping way is that, as shown in FIG. 12B, the seal member 71*a* is sandwiched between the heat exchanger fixing plate 80 and the projection 72 provided on the lowest part of the side of the heat exchanger nest 31, and the bolt 33 which penetrates through the projection 72 and the seal member 71*a* is screwed to the heat exchanger fixing plate 80. In case of using either of these ways, the secure sealing can be performed by elastically deforming the seal member. Additionally, by fixing the seal member to the heat exchanger nest with the adhesive, the leakage of the gas between the heat exchanger nest and the seal member can be more securely prevented.

Figure 13:
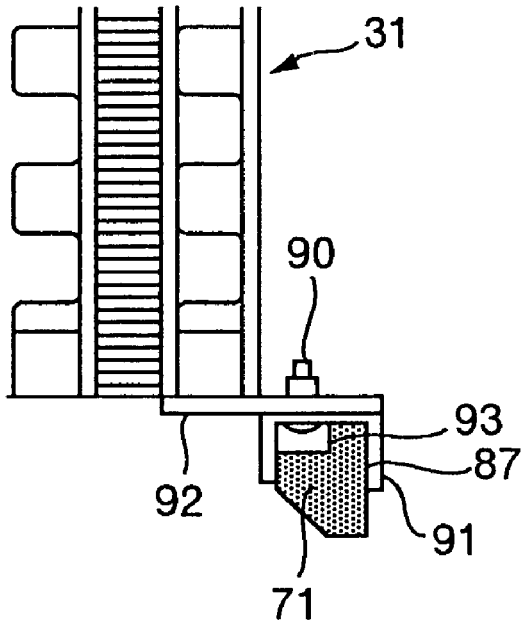

Still further variation of the present invention is shown in FIG. 13. A thin plate 92 is mounted on the bottom surface of the heat exchanger nest 31 so as to extend in a transverse direction of the heat exchanger nest 31, and a groove plate 91 having a U-shape in cross section is mounted to the existing portion with a bolt 90. Then, the seal member 71 is held in the groove 87 of the groove plate 91. According to this variation, even if the fixing bolt 90 is loosed and dropped during operation of the heat exchanger, it can be prevented that the dropped bolt 90 flows to the gas flow passage, because the receiving surface 93 is formed in the seal member 71.

Figure 14:
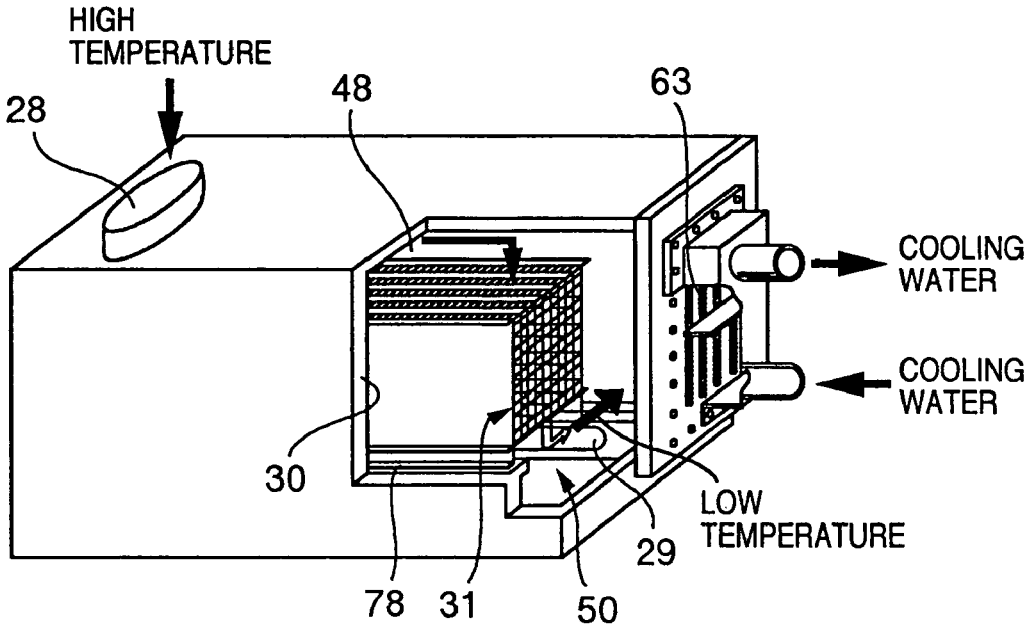
FIG. 14 is a view for explaining flow of air which flows in the heat exchanger according to the present invention.
Figure 15:
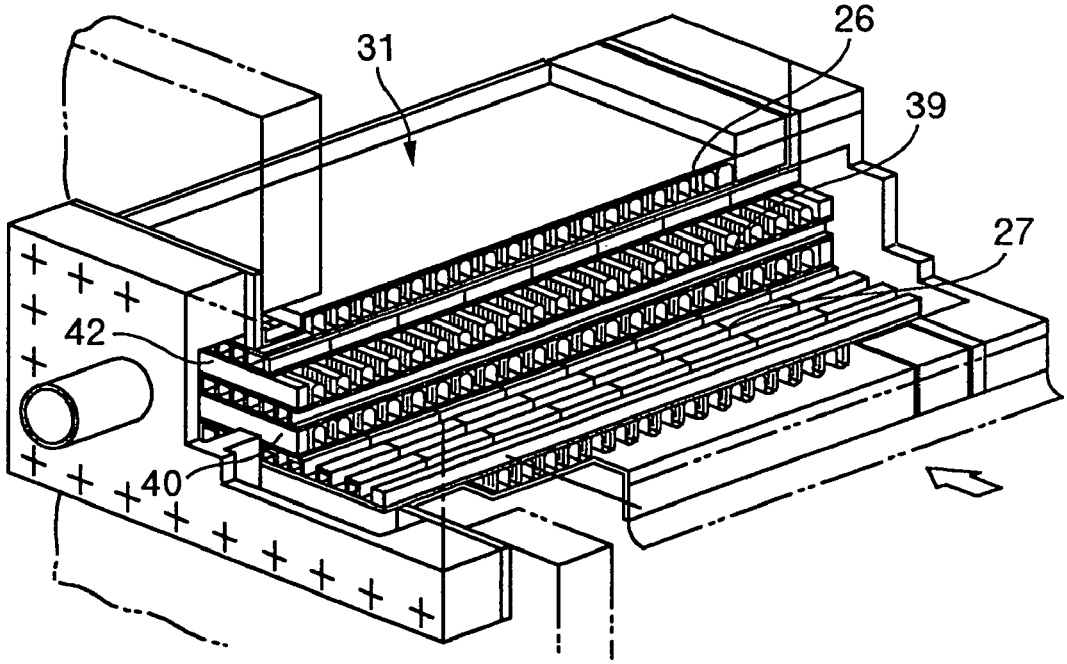
FIG. 15 is a view for explaining details of water chambers and gas chambers according to the present invention.

FIGS. 14 and 15 show a partly sectional perspective views of a heat exchanger using the seal members 71 and 71*a* shown in the above-described embodiments and variations. In FIG. 15, a bottom surface is shown on the left side of the figure, and a right side surface is shown on the lower side of the figure, for convenient of the description. The high temperature air 48 discharged from the compressor or the like is suctioned from the suction port 28, and performs the heat exchange with the cooling water in the heat exchanger nest 31 to become low temperature air 50, then the air is discharged from a discharging port 29 to the outside. On the side of the outlet and inlet port of the cooling water, a water chamber 63 is provided. The heat exchanger nest 31 has the water chambers (lines) and the gas chambers (lines) as described in detail in above-described embodiments, and they have the corrugated fins 26, 27. In FIG. 15, tube plates 27 are placed between the chambers, and an outer bar 29 is provided on the tube plate side.

According to the embodiments and variations described above, the heat exchanger nest can be readily removed from the container of the heat exchanger, and the sealing can be securely preformed, so that the reliable and efficient heat exchanger can be obtained. Additionally, cleaning and checking can be performed only by removing the cover, so that the maintenance ability is improved. Further, by decreasing the temperature of the working fluid at the outlet of the heat exchanger, the compressor power is reduced, which can contribute to the energy saving.

As described above in detail, in the compact type heat exchanger according to the present invention, the number of low temperature chambers is larger than that of the high temperature chambers by one chamber (one line), and the low temperature chambers are disposed at both ends, so that the compact heat exchanger having excellent cooling performance can be obtained. Further, the sealing ability inside the heat exchanger can be improved.

What is claimed is:

1. A heat exchanger for a screw-type air compressor, comprising:

a heat exchanger nest having a plurality of low temperature chambers through which cooling water flows and a plurality of high temperature chambers through which compressed air flows, the low temperature chambers and the high temperature chambers being alternately arranged in layers through a partition plate interposed therebetween, wherein the both ends of the layered heat exchanger nest are the low temperature chambers, wherein the number of the high temperature chambers is one less than the number of low temperature chambers, and wherein a flowing direction of the cooling water in the low temperature chambers and a flowing direction of the compressed air in the high temperature chambers are substantially orthogonal to each other; and a container for accommodating the heat exchanger nest, wherein the container is provided with a container side projecting seal formed on an inner side surface thereof, and the heat exchanger nest is provided with a nest side projecting seal formed on a side surface thereof, the container side projecting seal and the nest side projecting seal being coupled with each other through an elastically deformable seal member, so that a seal portion for partitioning the inside of the container is formed therein, wherein the seal member includes at least one of ethylene-propylene rubber, acrylic rubber, silicone rubber, and fluorocarbon rubber, as a principal component.

2. A heat exchanger according to claim 1, wherein the nest side projecting seal is in the vicinity of an outlet of the compressed air.

3. A heat exchanger according to claim 1, wherein the nest side projecting seal extends over a bottom surface area of the heat exchanger nest, so that compressive load is loaded on the seal member due to the mass of the heat exchanger nest.

4. A screw-type air compressor comprising the heat exchanger according to claim 1.

* * * * *